US005934562A

United States Patent [19]

Kwok

[11] Patent Number: 5,934,562

[45] Date of Patent: Aug. 10, 1999

[54] HOT MELT ADHESIVE DISPENSING SYSTEM WITH LAMINATED AIR HEATER

[75] Inventor: Kui-Chiu Kwok, Mundelein, Ill.

[73] Assignee: Illinois Tool Works Inc., Glenview, Ill.

[21] Appl. No.: 09/060,580

[22] Filed: Apr. 15, 1998

[51] Int. Cl.[6] ..... B05B 1/24; B05B 1/14; F24H 1/10

[52] U.S. Cl. ..... 239/135; 239/128; 239/555; 392/484

[58] Field of Search ..... 239/128, 135, 239/555; 392/379, 470, 479, 480, 481, 482, 484

[56] References Cited

U.S. PATENT DOCUMENTS

| | | | |
|---|---|---|---|
| 1,654,551 | 1/1928 | Muhleisen | 392/484 X |
| 4,785,996 | 11/1988 | Ziecker et al. | 239/135 X |
| 4,969,602 | 11/1990 | Scholl | 239/135 X |
| 5,145,689 | 9/1992 | Allen et al. . | |
| 5,245,693 | 9/1993 | Ford et al. | 392/470 |
| 5,381,510 | 1/1995 | Ford et al. | 392/470 |
| 5,478,224 | 12/1995 | McGuffey . | |
| 5,860,602 | 1/1999 | Tilton et al. | 239/555 X |

FOREIGN PATENT DOCUMENTS

| | | | |
|---|---|---|---|
| 979059 | 12/1975 | European Pat. Off. | 392/484 |

*Primary Examiner*—Andres Kashnikow
*Assistant Examiner*—Robin O. Evans
*Attorney, Agent, or Firm*—Donald J. Breh

[57] ABSTRACT

An air pre-heating apparatus useable for pre-heating air supplied to one or more hot melt adhesive dispensing nozzles mounted on an adhesive supply manifold. Air is supplied from an air supply inlet on an outer portion of an outer heating member to an air supply outlet on an inner heating member having a heater therein. The outer heating member formed of a plurality of laminated plates having one or more air flow paths, which include preferably a serpentine air flow path portion that increases the residence time of the air therein. The air is supplied through the apparatus against a decreasing temperature gradient whereby heat is increasingly added thereto before the air is supplied to the nozzles. The apparatus is preferably thermally isolated from the manifold to permit maintaining the pre-heating apparatus at a temperature different than a temperature of the manifold.

20 Claims, 3 Drawing Sheets

143
142
140

144
146
148
150

212
154
156
158
160
162
210
152

212
164
166
168
170
172
210
174

212
176
210
178
180
182
184
186

212
200
202
204
206
208
210
190
192
194
196
198
188

212
114
118
114
118
114
118
114
118
114
118
116
50
110
50
210
122

212
270
272
274
276
278
258
210
260
262
264
266
268

222

212
248
210
248
250
252
254
256

214
216
218
220

212
236
238
240
242
244
246
210

226
228
230
232
234
212
224
210

HOT MELT ADHESIVE DISPENSING SYSTEM WITH LAMINATED AIR HEATER

CROSS REFERENCE TO RELATED APPLICATIONS

The present application is related to copending U.S. application Ser. No. 08/843,224, filed Apr. 14, 1997, entitled "Improved Meltblowing Method and System", copending U.S. application Ser. No. 08/717,080, filed Oct. 8, 1996, entitled "Meltblowing Method and Apparatus", and copending U.S. application Ser. No. 08/683,064, filed Jul. 16, 1996 now U.S. Pat. No. 5,862,986, entitled "Hot Melt Adhesive Applicator With Metering Gear-Driven Head", all commonly assigned and incorporated herein by reference.

BACKGROUND OF THE INVENTION

The invention relates generally to hot melt adhesive dispensing systems, and more particularly to apparatuses for pre-heating air supplied to one or more hot melt adhesive dispensing nozzles mounted on a manifold supplying adhesive thereto.

In hot melt adhesive dispensing systems pre-heated air is used to control the dispensing of adhesives through one or more adhesive orifices of an adhesive dispensing nozzle. The pre-heated air is dispensed from one or more air orifices associated with each adhesive orifice to add heat to adhesive dispensed therefrom. The preheated air may also modify the flow of adhesive dispensed from the adhesive orifice, for example, to form and dispense adhesive fibers in swirling spiral patterns and also to form and dispense vacillating meltblown adhesive fibers. It is also desirable to pre-heat air and fluids for use in many other manufacturing operations.

U.S. Pat. No. 5,145,689, issued on Sep. 8, 1992, entitled "Meltblowing Die", discloses one known air pre-heating apparatus for meltblowing dies that dispense hot melt adhesives. The pre-heating apparatus comprises an air supply conduit having an axially disposed insulator core with a heater coil wound thereabout and along an axial dimension thereof. The heater coil extends radially outwardly from the insulator core toward an interior surface of the conduit and transfers heat to air flowing therethrough, whereby the pre-heated air is supplied to the meltblowing dies.

The referenced U.S. application Ser. No. 08/683,064, entitled "Hot Melt Adhesive Applicator With Metering Gear-Driven Head" discloses another known air pre-heating apparatus for hot melt adhesive dispensing systems comprising a common air supply conduit coupled to a plurality of parallel conduits disposed over several heating members. The plurality of parallel air supply conduits provide relatively increased surface area to improve heat transferred from the heating members to air.

The known prior art air pre-heaters suitable for hot melt adhesive dispensing applications, however, pre-heat air relatively inefficiently. Additionally, many hot melt adhesive dispensing systems include generally a heated manifold that supplies hot adhesive to the one or more adhesive dispensing nozzles coupled thereto. In some systems, the air pre-heating apparatus is coupled directly to the heated manifold. The pre-heated air may be supplied to the nozzles through conduits in the heated manifold. It is often desirable, however, to maintain the temperature of the pre-heated air supply at a temperature different than that of the heated manifold to optimally control adhesive dispensed from the nozzles. Prior art systems that mount the air pre-heater directly on the manifold, or supply the pre-heated air through the manifold to the nozzle, may increase or decrease the temperature of the pre-heated air supply, thereby adversely affecting the dispensing of fluid from the nozzles.

The present invention is drawn toward advancements in the art of preheating fluids, and more particularly to preheating air supplied to one or more hot melt adhesive dispensing nozzles mounted on a manifold, and combinations thereof.

It is an object of the invention to provide a novel fluid pre-heating apparatus useable for preheating air supplied to one or more hot melt adhesive dispensing nozzles mounted on an adhesive supply manifold, and combinations thereof, that are economical and that overcome problems in the prior art.

It is another object of the invention to provide a novel air pre-heating apparatus that preheats air relatively efficiently by supplying ambient air from an air supply inlet of the apparatus, through the apparatus against a decreasing temperature gradient therein, and to an air supply outlet of the apparatus, whereby heat is increasingly added thereto before the air is discharged from the air supply outlet.

It is a more particular object of the invention to provide a novel air pre-heating apparatus having an air supply inlet on or at least proximate an outer portion of an outer heating member and an air supply outlet on an inner heating member having a heater therein. The outer heating member comprises generally a plurality of laminated plates having one or more air flow paths, which preferably include one or more serpentine air flow path portions that increase the residence time of the air therein. The air is supplied from the air supply inlet, and through the apparatus against a decreasing temperature gradient, whereby heat is increasingly added thereto before the air is discharged from the air supply outlet of the apparatus, which may be coupled to an adhesive dispensing nozzle.

It is a further object of the invention to provide a novel fluid pre-heating apparatus useable for pre-heating air supplied to one or more hot melt adhesive dispensing nozzles mounted on an adhesive supply manifold, wherein the air pre-heating apparatus is thermally isolated from the manifold to permit maintaining the pre-heating apparatus at a temperature different than a temperature of the manifold.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
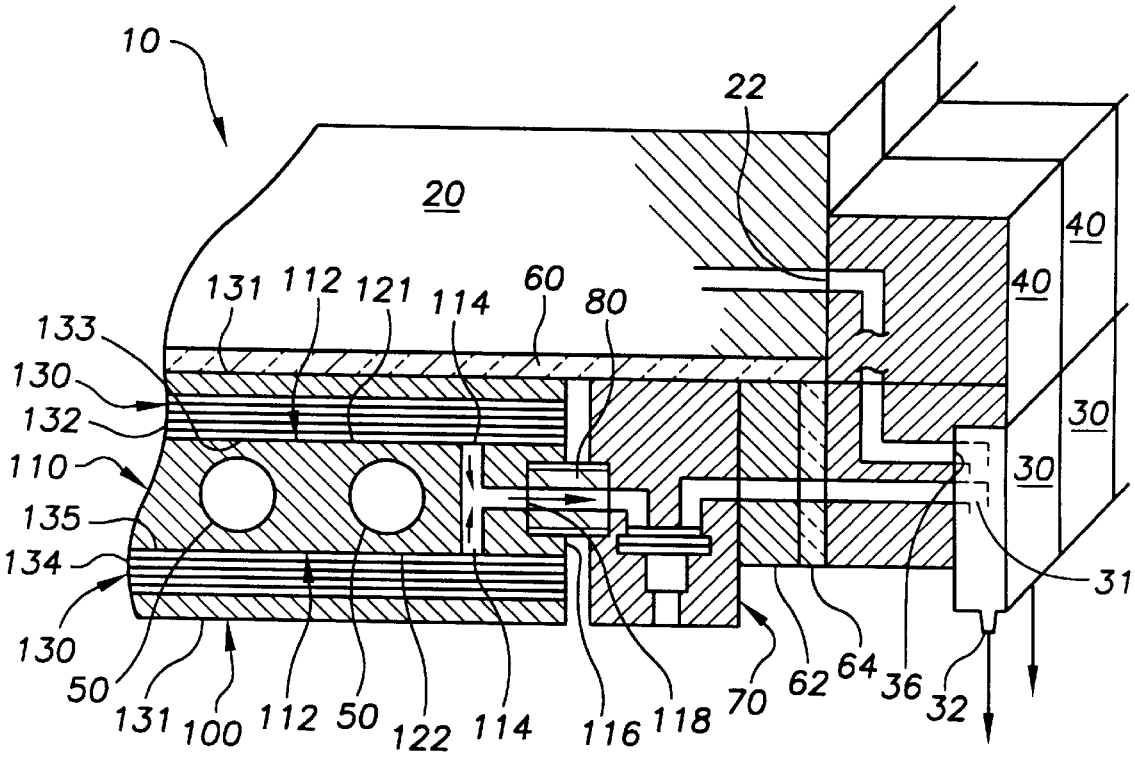
FIG. 1 is a partial sectional perspective view of an air pre-heating apparatus coupled to a hot melt adhesive dispensing system according to an exemplary embodiment of the present invention.

FIG. 1 is a hot melt adhesive dispensing system 10 comprising generally a manifold 20 for supplying adhesive to a plurality of adhesive dispensing nozzles 30 coupled to a corresponding plurality of adhesive outlets 22 on the manifold 20. The nozzles 30 generally include an air inlet and an adhesive inlet 36 coupled to the adhesive outlet 22 of the manifold 20. The supply of adhesive from the manifold 20 to the nozzles 30 is controlled for example by corresponding pneumatically operated adhesive flow control modules 40 disposed therebetween. An exemplary flow control module suitable for this application is the MR-1300 pneumatically operated module, by ITW Dynatec, Hendersonville, Tenn. The supply of hot melt adhesives from manifolds 20 to a plurality of adhesive dispensing nozzles 30 mounted thereon is disclosed generally in the referenced copending U.S. application Ser. No. 08/683,064, entitled "Hot Melt Adhesive Applicator With Metering Gear-Driven Head".

The nozzles 30 comprise generally at least one adhesive dispensing orifice 32 and one or more air dispensing orifices for modifying the flow of adhesive therefrom as is known. The nozzles 30 may be spiral nozzles that form and dispense adhesive fibers in swirling spiral patterns, or meltblowing nozzles that form and dispense vacillating meltblown adhesive fibers, or other types of adhesive dispensing nozzles. The flow control modules 40 may also control the supply of pre-heated air to the corresponding nozzles 30. The supply of hot melt adhesives from a manifold to a plurality of meltblowing adhesive dispensing nozzles is disclosed generally in the referenced copending U.S. application Ser. No. 08/843,224, entitled "Improved Meltblowing Method and System", and the copending U.S. application Ser. No. 08/717,080, entitled "Meltblowing Method and Apparatus".

Figure 2:
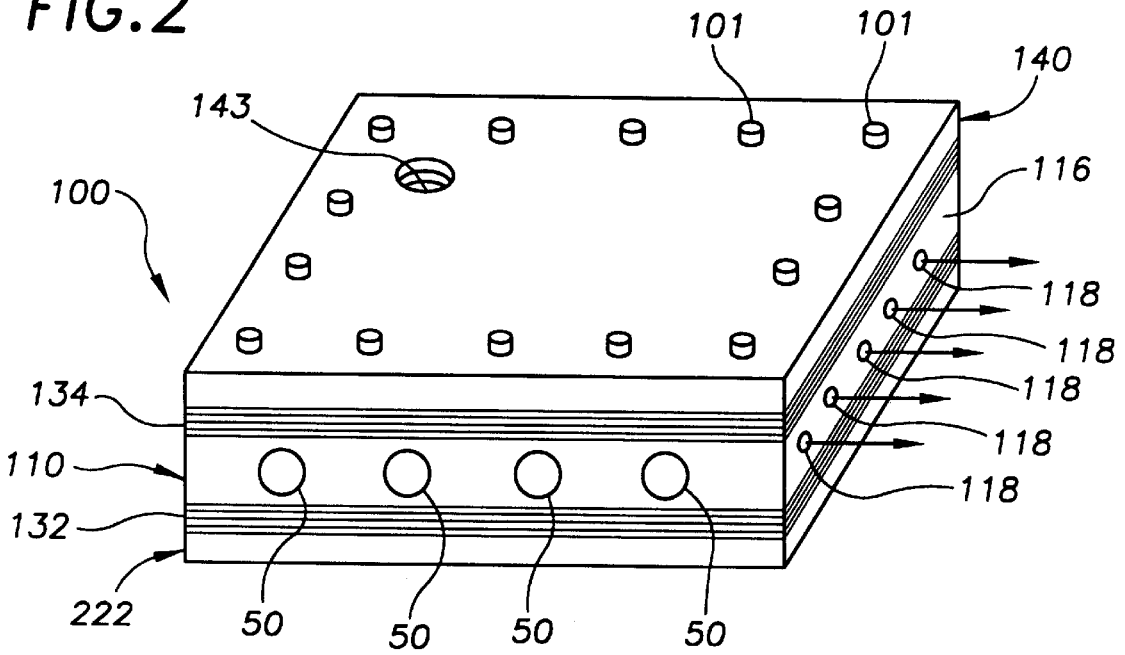
FIG. 2 is a perspective view of a laminated air pre-heating apparatus.

FIGS. 1 and 2 illustrate a fluid heating apparatus 100 useable in combination with the hot melt adhesive dispensing system 10 for pre-heating air supplied to one or more adhesive dispensing nozzles 30. The apparatus 100 comprises generally an inner heating member 110 having one or more heaters 50, preferably electrical heaters and a thermocouple, disposed therein. The apparatus 100 also comprises generally an outer heating member 130 coupled to the inner heating member 110. The heaters 50 form a temperature gradient in the apparatus that decreases with increasing distance therefrom, wherein the temperature of the apparatus 100 decreases from the inner heating member 110 toward outer portions of the outer heating member 130.

To pre-heat fluid, ambient fluid is supplied through the apparatus 100 from an area of lower temperature to an area of higher temperature, generally against the temperature gradient, so that heat is increasingly added to the fluid, whereby the heated fluid is discharged from the apparatus 100 upon reaching its maximum temperature. More particularly, ambient fluid is supplied to the fluid supply inlet of the apparatus 100, located preferably on or near an outer side 131 of the outer heating member 130, where the temperature of the apparatus 100 is relatively low. The fluid is then supplied through the apparatus 100, generally opposing the decreasing temperature gradient, to a fluid supply outlet of the apparatus 100, located preferably on an outer side 116 of the inner heating member 110, where the temperature of the apparatus 100 is relatively high.

The fluid is preferably supplied along one or more serpentine path portions within the apparatus 100 to increase its residence time therein, without substantially increasing the size of the apparatus, and more particularly without increasing the thickness thereof, to transfer heat from the apparatus 100 to the fluid increasingly and relatively efficiently as the fluid is supplied between a fluid supply inlet and fluid supply outlet of the apparatus 100.

FIG. 1 illustrates the inner heating member 110 comprising generally an outer surface 112 having one or more fluid inlets 114 coupled to one or more fluid supply outlets 118 on an outer side 116 of the inner heating member 110, wherein the fluid supply outlets 118 are couplable to corresponding nozzles 30. In the exemplary embodiment, the outer surface 112 of the inner heating member 110 includes first and second generally opposing planar outer surfaces 121 and 122. In alternative configurations, the first and second generally opposing outer surfaces 121 and 122 are curved outwardly, or the inner heating member 110 may be a cylindrical member with heaters disposed axially therein, wherein the outer surface 112 is also cylindrical.

The first and second outer surfaces 121 and 122 of the inner heating member 110 each include corresponding first and second fluid inlets 114 coupled to a common fluid supply outlet 118 of the inner heating member 110. Generally, there is at least one, and in the exemplary embodiment two fluid inlets 114, for each fluid supply outlet 118 of the inner heating member 110. FIG. 2 illustrates a plurality of fluid supply outlets 118 on the outer side 116 of the inner heating member 110, wherein each fluid outlet 118 is coupled preferably to a corresponding fluid inlet 114 from each of the first and second outer surfaces 121 and 122 of the inner heating member 110, whereby fluid from the fluid inlets 114 on the first and second sides 121 and 122 of the inner heating member 110 combine to supply fluid to the corresponding fluid supply outlet 118. In one application, the plurality of fluid supply outlets 118 of the inner heating member 110 is coupled generally to a corresponding plurality of fluid dispensing nozzles 30, as illustrated generally in FIG. 1 and discussed further below.

In FIGS. 1 and 2, the outer heating member 130 comprises first and second generally opposing planar outer heating members 132 and 134 disposed on the outer surface of the inner heating member 110. More particularly, the first and second outer heating members 132 and 134 include corresponding first and second inner surfaces 133 and 135, respectively, mounted on the first and second outer surfaces 121 and 122 of the inner heating member 110. In alternative configurations, the first and second inner surfaces 133 and 135 of the first and second outer heating members 132 and 134 are curved inwardly, and are mountable on corresponding outwardly curved first and second outer surfaces 121 and 122 of the inner heating member 110. In another alternative embodiment, the outer surface 112 of the inner heating member is cylindrical, and the outer heating member 130 is one or more cylindrical members disposed thereabout, as discussed above.

The first and second outer heating members 132 and 134 include generally a fluid supply inlet on or at least proximate an outer side thereof, and coupled to corresponding first and second fluid outlets on the first and second inner surfaces 133 and 135 thereof by corresponding first and second fluid flow paths through the first and second outer heating members 132 and 134. The fluid supply inlets of the outer heating members 132 and 134 are generally coupled to an external fluid supply source. In FIG. 2, a second fluid supply inlet 143 is disposed on the outer side of the second outer heating member 134, and is coupled directly to an external fluid supply source, not shown. A fluid supply flow path extending from the second fluid supply inlet 143, and at least partially through the apparatus, not shown in FIG. 2, supplies fluid therefrom to the first fluid supply inlet proximate the outer side 131 of the first outer heating member 132, as discussed below. The fluid supply inlet 143 may alternatively be disposed on an end portion of one or both the first and second outer heating members, preferably near the outer sides 131 thereof. Thus configured, fluid is supplied from portions of the first and second outer heating members 132 and 134 at relatively low temperatures, generally against the thermal gradient, toward the inner heating member 110, which is at a relatively high temperature.

The first and second inner surfaces 133 and 135 of the first and second outer heating members 132 and 134 each have a plurality of fluid outlets coupled to a corresponding plurality of fluid inlets 114 on the first and second outer side surfaces 121 and 122 of the inner heating member 110.

The first fluid flow path between the first fluid supply inlet of the first outer heating member 132 and the plurality of fluid outlets of the first inner surface 133 are preferably separated into a plurality of generally parallel fluid flow paths corresponding to the plurality of fluid outlets. The plurality of fluid outlets of the first outer heating member 132 are coupled to the corresponding plurality of fluid inlets 114 on the first outer surface 121 of the inner heating member 110. The second outer heating member 134 is configured similarly, and in one embodiment the plurality of first fluid flow paths of the first outer heating member 132 are mirror images of the plurality of second fluid flow paths of the second outer heating member 134. Separating the fluid flow paths into a plurality of fluid flow paths between the fluid supply inlet and the corresponding plurality of fluid outlets of the outer heating members increases the efficiency of heat transfer from the outer heating member 110 to the fluid supplied therethrough.

The plurality of first and second fluid flow paths between the corresponding first and second fluid supply inlets of the first and second outer heating members and the plurality of first and second fluid outlets of the first and second outer heating members each preferably include at least one and preferably several serpentine fluid flow path portions. The serpentine fluid flow path portions increase the residence time of the fluid in the corresponding outer heating member, without substantially increasing the size, or thickness, thereof, thereby further increasing the efficiency of heat transferred to the fluid supplied therethrough.

The temperature of the apparatus 100 decreases generally from the first and second outer surfaces 121 and 122 of the inner heating member to the first and second outer sides 131 of the first and second outer heating members 132 and 134. It is thus desirable to locate the fluid supply inlet on or at least near the outer sides of the first and second outer heating members 132 and 134, and to flow the fluid inwardly through the apparatus, generally against the thermal gradient, toward the inner heating member 110, whereby fluid is increasingly heated as it moves from the fluid supply inlets toward the fluid inlets on the first and second outer surfaces 121 and 122 of the inner heating member 110. The pre-heated fluid is then supplied through the inner heating member 110, where the temperature is maximum, to one or more fluid outlets 118 on the outer side 116 of the apparatus 100 and discharged therefrom toward corresponding fluid supply nozzles 30, or other loads.

FIGS. 1 and 2 illustrate the first and second outer heating members 132 and 134 each comprising generally a plurality of laminated plates, which may be planar or curved, mounted on a planar or curved outer surface 112 of the inner heating member 110, wherein the first and second fluid flow paths through the first and second outer heating members 132 and 134 pass through the plurality of laminated plates, generally against the thermal gradient, toward the inner heating member 110.

Figures 3A, 3B, 3C, 3D, 3E, 3F, 3G:
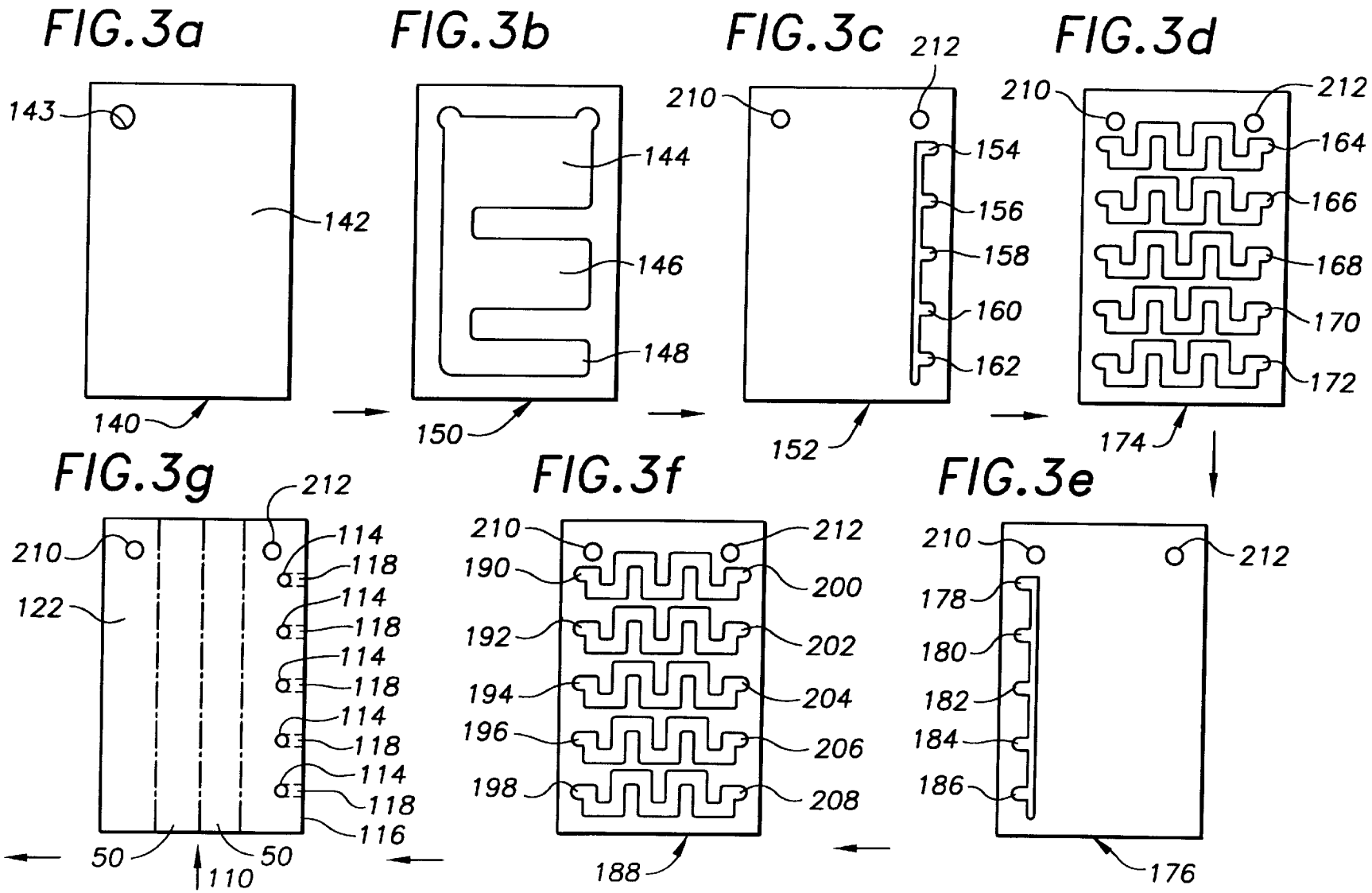
FIGS. 3*a*–3*m* are several plate members comprising a laminated air pre-heating apparatus according to an exemplary embodiment of the present invention.
Figures 3H, 3I, 3J, 3K, 3L, 3M:
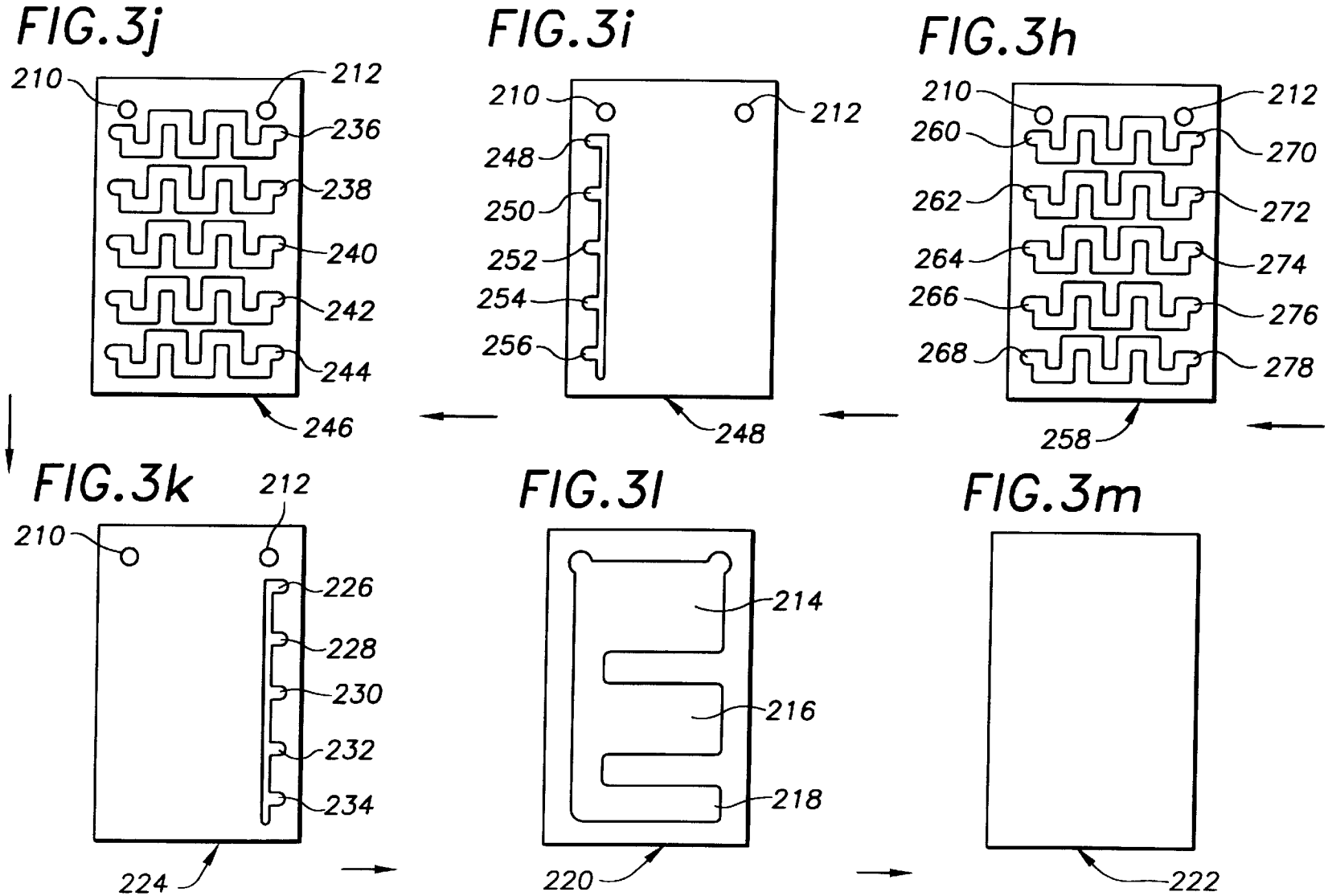

In FIGS. 3*a*–3*m*, a plurality of plates are stacked one on top of the other to form the apparatus 100 of the exemplary embodiment, wherein the plate of FIG. 3*a* is a first end plate and the plate of FIG. 3*m* is a second opposing end plate of the apparatus 100 illustrated in FIGS. 1 and 2. More particularly, the plates of FIGS. 3*a*–3*f* correspond to the second outer heating member 134, the plate of FIG. 3*g* corresponds to the inner heating member 110, and the plates of FIGS. 3*h*–3*m* correspond to the first outer heating member 132, as discussed further below. Alternatively, a plurality of plates forming the outer heating member may be disposed concentrically one on top of the other about a cylindrical inner heating member.

In FIG. 3*a*, a first plate 140 includes an outer side 142 corresponding to the outer side 131 of the second outer heating member 134, and an opening 143 connectable to an external fluid supply source, not shown, for supplying fluid to the apparatus. The opening 143 thus forms a fluid supply inlet on the outer side 131 of the second outer heating member 134. The fluid is supplied from the opening 143 to one or more cavities 144, 146 and 148 formed in a second plate 150 of FIG. 3*b*, which is disposed between the first plate 140 of FIG. 3*a* and a third plate 152 of FIG. 3*c*.

The fluid supplied to the one or more cavities 144, 146 and 148 of the second plate 150 of FIG. 3*b* moves thereacross and through a plurality of openings 154, 156, 158, 160 and 162 that extend through the third plate 152 to a corresponding plurality of fluid flow path portions 164, 166, 168, 170 and 172 formed in and across a fourth plate 174 of FIG. 3*d*, which is disposed between the third plate 152 of FIG. 3*c* and a fifth plate 176 of FIG. 3*e*.

The fluid supplied to the plurality of fluid flow path portions 164, 166, 168, 170 and 172 of the fourth plate 174 of FIG. 3*d* moves thereacross and through a corresponding plurality of openings 178, 180, 182, 184 and 186 that extend through the fifth plate 176 of FIG. 3*e* to a sixth plate 188 of FIG. 3*f*. A corresponding plurality of fluid flow path portions 190, 192, 194, 196 and 198 are formed in and across the sixth plate 188 of FIG. 3*f*, which is disposed between the fifth plate 176 of FIG. 3*e* and the inner heating member plate 110 of FIG. 3*g*.

The fluid supplied to the plurality of fluid flow path portions 190, 192, 194, 196 and 198 of the sixth plate 188 of FIG. 3*f* moves thereacross to a corresponding plurality of fluid outlets 200, 202, 204, 206 and 208 that extend through the sixth plate 188. The plurality of fluid outlets 200, 202, 204, 206 and 208 of the sixth plate 188 of FIG. 3*f* communicate with a corresponding plurality of fluid inlets 114 on the second outer surface of the inner heating member 110 of FIG. 3*g*, illustrated best in FIG. 1, which supplies fluid to the corresponding fluid supply outlets 118 on the outer side 116 of the inner heating member 110.

The fluid supplied from the opening 143 to the one or more cavities 144, 146 and 148 formed in the second plate 150 of FIG. 3*b* is also supplied through fluid conduits formed by aligned pairs of openings 210 and 212 formed through the plates of FIGS. 3*c*–3*k* to one or more cavities 214, 216 and 218 formed in a seventh plate 220 of FIG. 31, which is disposed between an eighth plate 222 of FIG. 3*m* and a ninth plate 224 of FIG. 3*k*. The fluid conduits are formed by the pairs of aligned openings 210 and 212 through the plates of FIGS. 3*c*–3*k*. The opening 143 thus supplies fluid through the aligned pairs of openings 210 and 212 to a fluid supply inlet on the plate of FIG. 31, located proximate an outer side of the first outer heating member formed by the plates of FIGS. 3*h*–3*m*.

The fluid supplied to the one or more cavities 214, 216 and 218 of the seventh plate 220 of FIG. 31 moves thereacross and through a plurality of openings 226, 228, 230, 232 and 234 that extend through the ninth plate 224 of FIG. 3*k* to a corresponding plurality of fluid flow path portions 236, 238, 240, 242 and 244 formed in and across a tenth plate 246 of FIG. 3*j*, which is disposed between the ninth plate 224 of FIG. 3*k* and an eleventh plate 248 of FIG. 3*i*.

The fluid supplied to the plurality of fluid flow path portions 236, 238, 240, 242 and 244 of the tenth plate 246 of FIG. 3*j* moves thereacross and through a corresponding plurality of openings 248, 250, 252, 254 and 256 that extend through the eleventh plate 248 of FIG. 3*i* to a twelfth plate 258 of FIG. 3*h*. A corresponding plurality of fluid flow path portions 260, 262, 264, 266 and 268 are formed in and across the twelfth plate 258 of FIG. 3*h*, which is disposed between the eleventh plate 248 of FIG. 3*i* and the inner heating member plate 110 of FIG. 3*g*.

The fluid supplied to the plurality of fluid flow path portions 260, 262, 264, 266 and 268 of the twelfth plate 258 of FIG. 3*h* moves thereacross to a corresponding plurality of fluid outlets 270, 272, 274, 276 and 278 that extend through the twelfth plate 258. The plurality of fluid outlets 270, 272, 274, 276 and 278 of the twelfth plate 258 of FIG. 3*h* communicate with a corresponding plurality of fluid inlets 114 on the first outer surface of the inner heating member 110 of FIG. 3*g*, illustrated best in FIG. 1, which supplies fluid to the corresponding fluid supply outlets 118 on the outer side 116 of the inner heating member 110.

The fluid flow path portions of the plates of FIGS. 3*d*, 3*f*, 3*h* and 3*j* is preferably a serpentine fluid flow path portion to increase the residence time of the fluid therein thereby increasing the efficiency of heat transfer to the fluid supplied therethrough as discussed above. Alternative embodiments may include more or less plates having the plurality of serpentine fluid flow path portions. For example, an additional set of plates corresponding to the plates of FIGS. 3*c*–3*f* may be stacked between the plates of FIGS. 3*f* and 3*g*, thereby increasing two-fold the length of the serpentine fluid flow path portions in the second outer heating member. And similarly, an additional set of plates corresponding to the plates of FIGS. 3*h*–3*k* may be stacked between the plates of FIGS. 3*h* and 3*g*, thereby increasing two-fold the length of the serpentine fluid flow path portions in the first outer heating member.

Since the serpentine fluid flow path portions, and the fluid flow paths generally, are formed in the plane of the plates, the fluid flow paths may be increased substantially by adding additional plates, thereby maximizing the path length and therefore the residence time of the air within the apparatus, without substantially increasing the size or thickness thereof.

The plates of the exemplary embodiment generally have the same thickness, which may be determined by the size of the conduits or cavities defined thereby. Preferably, the plates of FIGS. 3*b*–3*f* and FIGS. 3*h*–3*l* forming the first and second outer heating members have the same thickness, and the outer plates of FIGS. 3*a* and 3*m* are relatively thick, rigid plates for clamping the apparatus together as discussed further below. The plate of FIG. 3*g*, which forms the inner heating member 110, is preferably a single relatively thick plate, since it may be fabricated relatively easily. In other embodiments, the plates accommodating fluid flow in a plane thereof, for example the plate of FIGS. 3*b*, 3*d*, 3*f*, 3*h*, 3*j* and 31, may be thicker than the plates through which the fluid flows transversely therethrough, for example the plates of FIGS. 3*a*, 3*c*, 3*e*, 3*i*, and 3*k*.

The plates of the inner and outer heating members are formed preferably of materials having high thermal conductivity. In one embodiment, the first and second end plates of FIGS. 3*a* and 3*m* and the inner heating member plate of FIG. 3*g* are stainless steel or aluminum plates, and the other plates of FIGS. 3*b*–3*f* and 3*h*–3*l* are brass. FIGS. 1 and 2 illustrate the first end plate 140 and the second end plate 222 being relatively thick to clamp the other plates of the first and second outer heating members to the inner heating member 110. The plates are preferably clamped firmly together without leakage therebetween to provide good surface contact and heat transfer therebetween. In FIG. 2, a plurality of fasteners 101 like screws or rivets 101 are disposed through and retain the plates of the apparatus 100, alone or in combination with adhesive therebetween. FIG. 2 also illustrates the first end plate 140 thicker than the second end plate 222 to accommodate means, not shown, for coupling the external fluid source to the opening 143. The plates are fabricated by stamping, punching, chemical etching, machining, or laser cutting operations among other processes, which are relatively cost effective and provide substantial design flexibility.

FIG. 1 illustrates the apparatus 100 thermally isolated from the manifold 20, preferably coupled thereto by an insulating member 60, whereby the apparatus 100 is maintainable at a temperature different than a temperature of the manifold 20. FIG. 1 also illustrates an air supply control valve 70 disposed between the air supply outlet, or outlets, 118 of the inner heating member 100 and the corresponding nozzle 30. The air supply control valve 70 is preferably located as closely as possible to the nozzle 30 to provide more responsive control over the air supplied thereto. In the exemplary embodiment, the air supply control valve 70 is coupled to the fluid supply outlet 118 of the apparatus 100 by a coupling member 80 that provides fluid tight coupling therebetween, and preferably has some thermal insulating properties. An adapter member 62 and additional thermal insulating material 64 may be disposed between the air supply control valve 70 and the nozzle 30, and between the apparatus and the air supply control valve if required, to facilitate coupling therebetween. The air supply control valve 70 is preferably a reed valve of the type disclosed in U.S. Pat. No. 5,478,224 issued Dec. 26, 1995, entitled "Apparatus for Depositing A Material On A Substrate And An Applicator Therefor", assigned commonly herewith, and incorporated herein by reference.

While the foregoing written description of the invention enables one of ordinary skill to make and use what is considered presently to be the best mode thereof, those of ordinary skill will appreciate and acknowledge the existence of variations, combinations, and equivalents of the specific exemplary embodiments herein. The invention is therefore to be limited not by the exemplary embodiments, but by all embodiments within the scope and spirit of the appended claims.

What is claimed is:

1. A fluid heating apparatus useable for pre-heating air supplied to a hot melt adhesive dispensing nozzle, the apparatus comprising:

an inner heating member having a heater disposed therein, the inner heating member having an outer surface with a fluid inlet, the inner heating member having an outer side with a fluid supply outlet;

an outer heating member having an inner surface coupled to the outer surface of the inner heating member, the outer heating member having a fluid outlet on the inner surface coupled to the fluid inlet of the inner heating member, the outer heating member having a fluid supply inlet at least proximate an outer side of the outer heating member, and coupled to the fluid outlet of the outer heating member by a fluid flow path through the outer heating member, a temperature of the apparatus decreasing from the outer surface of the inner heating member to the outer side of the outer heating member, whereby fluid is increasingly heated between the fluid supply inlet of the outer heating member and the fluid inlet of the inner heating member.

2. The apparatus of claim 1, the outer heating member is a plurality of laminated plates mounted on the outer surface of the inner heating member, the fluid flow path between the fluid supply inlet of the outer heating member and the fluid outlet of the outer heating member passes through the plurality of laminated plates.

3. The apparatus of claim 2, the outer surface of the inner heating member is planar, and the plurality of laminated plates are planar.

4. The apparatus of claim 1, the fluid flow path between the fluid supply inlet of the outer heating member and the fluid outlet of the outer heating member includes a serpentine fluid flow path portion.

5. The apparatus of claim 2, the fluid flow path between the fluid supply inlet of the outer heating member and the fluid outlet of the outer heating member is separated into a plurality of at least two fluid flow paths, each fluid flow path includes a serpentine fluid flow path portion in a plane of at least one of the laminated plates.

6. The apparatus of claim 5, the outer side of the inner heating member comprises a plurality of fluid supply outlets each coupled to a corresponding one of the plurality of fluid flow paths.

7. The apparatus of claim 1, the outer surface of the inner heating member having a first outer surface with a first fluid inlet coupled to the fluid supply outlet of the inner heating member and a generally opposing second outer surface with a second fluid inlet coupled to the fluid supply outlet of the inner heating member, the outer heating member comprising a first outer heating member having a first inner surface mounted on the first outer surface of the inner heating member, the first inner surface having a first fluid outlet coupled to the first fluid inlet of the inner heating member, the first outer heating member having a first fluid supply inlet at least proximate a first outer side of the first outer heating member, and the first outer heating member having a first fluid flow path from the first fluid supply inlet to the first fluid outlet, the outer heating member comprising a second outer heating member having a second inner surface mounted on the second outer surface of the inner heating member, the second inner surface having a second fluid outlet coupled to the second fluid inlet of the inner heating member, the second outer heating member having a second fluid supply inlet at least proximate a second outer side of the second outer heating member, and the second outer heating member having a second fluid flow path from the second fluid supply inlet to the second fluid outlet, the temperature of the apparatus decreasing from the first and second outer surfaces of the inner heating member to the first and second outer sides of the first and second outer heating members, whereby fluid is increasingly heated between the first and second fluid supply inlets of the first and second outer heating members and the first and second fluid inlets of the inner heating member.

8. The apparatus of claim 7, the first fluid flow path of the first outer heating member is a mirror image of the second fluid flow path of the second outer heating member.

9. The apparatus of claim 7, the second fluid supply inlet of the second outer heating member is coupled to the first fluid supply inlet of the first outer heating member by a fluid supply flow path extending at least partially through the apparatus.

10. The apparatus of claim 7, each of the first and second outer heating members is a plurality of laminated plates mounted on corresponding first and second outer surfaces of the inner heating member, the first and second fluid flow paths between the corresponding first and second fluid supply inlets of the first and second outer heating members and the first and second fluid outlets of the first and second outer heating members each include a serpentine fluid flow path portion in a plane of at least one of the laminated plates.

11. The apparatus of claim 10, the outer side of the inner heating member comprises a plurality of at least two fluid supply outlets, and the first and second fluid flow paths of the first and second outer heating members are each separated into a plurality of at least two fluid flow paths, each fluid flow path includes a serpentine fluid flow path portion in a plane of at least one of the laminated plates, a corresponding one of the plurality of fluid flow paths in each of the first and second outer heating members is combined to supply fluid to a corresponding one of the plurality of fluid supply outlets of the inner heating member.

12. The apparatus of claim 10, the first and second surface portions of the inner heating members are planar, and the plurality of laminated plates of the first and second outer heating members are planar.

13. The apparatus of claim 10 further comprising first and second clamping plates mounted on corresponding first and second outer sides of the first and second outer heating members for clamping the first and second outer heating members to the inner heating member.

14. The apparatus of claim 1, the inner and outer heating members are formed of a material having a high thermal conductivity, and the heater is an electrical heater.

15. A hot melt adhesive dispensing system comprising:

manifold having an adhesive outlet;

an adhesive dispensing nozzle having an air inlet and an adhesive inlet coupled to the adhesive outlet of the manifold;

an air pre-heating apparatus having an air supply outlet coupled to the air inlet of the nozzle;

the air pre-heating apparatus comprising an inner heating member having a heater disposed therein, the air supply outlet on an outer side of the inner heating member, the inner heating member having a first outer surface with a first air inlet coupled to the air supply outlet of the inner heating member and a generally opposing second outer surface with a second air inlet coupled to the air supply outlet of the inner heating member, the air pre-heating apparatus comprising a first outer heating member having a first inner surface mounted on the first outer surface of the inner heating member, the first inner surface having a first air outlet coupled to the first air inlet of the inner heating member, the first outer heating member having a first fluid supply inlet at least proximate a first outer side of the first outer heating member, the first outer heating member having a first air flow path from the first air supply inlet to the first air outlet, the air pre-heating apparatus comprising a second outer heating member having a second inner surface mounted on the second outer surface of the inner heating member, the second inner surface having a second air outlet coupled to the second air inlet of the inner heating member, the second outer heating member having a second fluid supply inlet at least proximate a second outer side of the second outer heating member, the second outer heating member having a second air flow path from the second air supply inlet to the second air outlet, a temperature of the pre-heating apparatus decreasing from the first and second outer surfaces of the inner heating member to the first and second outer sides of the first and second outer heating members, whereby air is increasingly heated as the air is supplied from the first and second air supply inlets of the first and second outer heating members to the air supply outlet of the inner heating member.

16. The system of claim 15, the second air supply inlet of the second outer heating member is coupled to the first air supply inlet of the first outer heating member by an air supply flow path extending at least partially through the apparatus.

17. The system of claim 15, each of the first and second outer heating members is a plurality of laminated plates mounted on corresponding first and second outer surfaces of the inner heating member, the first and second air flow paths between the corresponding first and second air supply inlets of the first and second outer heating members and the first and second air outlets of the first and second outer heating members each include a serpentine air flow path portion in a plane of at least one of the laminated plates.

18. The system of claim 15, manifold having an plurality of adhesive outlets;

a plurality of nozzles each having an air inlet and an adhesive inlet coupled to a corresponding adhesive outlet of the manifold;

the air pre-heating apparatus having a plurality of air supply outlets on the outer side of the inner heating member, each air supply outlet of the inner heating member coupled to a corresponding air supply inlet of the plurality of nozzles;

the first and second air flow paths of the first and second outer heating members are each separated into a plurality of air flow paths, each air flow path includes a serpentine air flow path portion in a plane of at least one of the laminated plates, a corresponding one of the plurality of air flow paths in each of the first and second outer heating members is combined to supply air to a corresponding one of the plurality of air supply outlets of the inner heating member.

19. The system of claim 15 further comprising an air supply control valve disposed between the air supply outlet of the inner heating member and the nozzle.

20. The system of claim 15 further comprising the air pre-heating apparatus is thermally isolated from the manifold, whereby the air pre-heating apparatus is maintainable at a temperature different than a temperature of the manifold.

* * * * *